United States Patent [19]

Zagranski et al.

[11] 4,454,754

[45] Jun. 19, 1984

[54] ENGINE FAILURE DETECTOR

[75] Inventors: Raymond D. Zagranski, Somers; Albert H. White, Wethersfield, both of Conn.

[73] Assignee: Chandler Evans, Inc., West Hartford, Conn.

[21] Appl. No.: 382,113

[22] Filed: May 26, 1982

[51] Int. Cl.³ ..... G01M 15/00

[52] U.S. Cl. ..... 73/117.3; 340/52 R

[58] Field of Search ..... 73/117.3, 116, 118; 340/27 R, 27 SS, 52 R

[56] References Cited

U.S. PATENT DOCUMENTS 3,426,322 2/1969 Balo ..... 340/27 SS 3,678,742 7/1972 Westcott et al. ..... 73/117.3

*Primary Examiner*—Jerry W. Myracle

[57] ABSTRACT

The failure of a gas turbine engine, particularly flame-out or output drive train breakage, is immediately detected and a warning signal generated. Engine flame-out is defined as an unacceptably fast gas turbine deceleration rate while output shaft failure is determined by sensing a mismatch between the engine output shaft speed and load speed.

11 Claims, 1 Drawing Figure

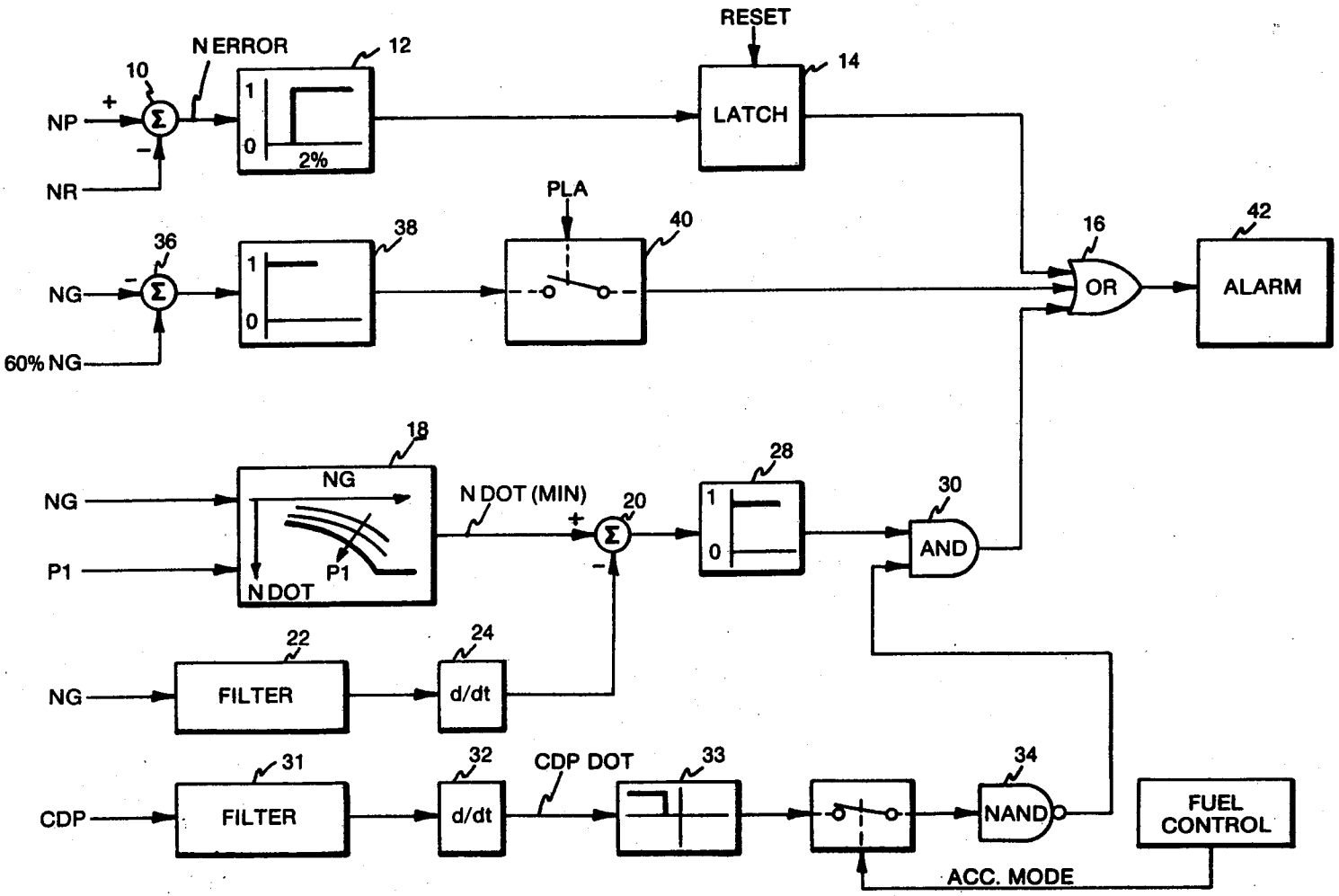
NP
NR
10
N ERROR
12
2%
1
0
RESET
14
LATCH
NG
60% NG
36
38
PLA
40
16
OR
42
ALARM
NG
P1
18
NG
P1
N DOT
N DOT (MIN)
20
28
30
AND
NG
22
FILTER
24
d/dt
CDP
31
FILTER
32
d/dt
CDP DOT
33
34
NAND
ACC. MODE
FUEL CONTROL

ENGINE FAILURE DETECTOR

TECHNICAL FIELD

The present invention relates to enhancing the safety of operation of gas turbine engines and particularly to providing an engine failure warning to the pilot of an aircraft powered by a free turbine engine. More specifically, this invention is directed to an engine failure detector which provides a warning signal in the case of an engine flame-out or output shaft breakage. Accordingly, the general objects of the present invention are to provide novel and improved methods and apparatus of such character.

BACKGROUND ART

While not limited thereto in its utility, the present invention is particularly well suited for employment on rotary wing aircraft. Such aircraft presently employ, as their source of power, turboshaft, i.e., free turbine, engines. Such engines include a gas generator and a free turbine driven by the exhaust products of the gas generator but not mechanically coupled thereto. The load, which constitutes the main and tail rotors in a rotary wind aircraft environment, is mechanically coupled to the free turbine. Two principal types of engine failure in a rotary wing aircraft are gas generator "flame-out" and a mechanical failure in the drive train between the free turbine and rotors.

Prior art gas turbine engine failure detectors have the rather serious deficiency of requiring, in the case of a flame-out failure, several seconds before providing a warning. Thus, present flame-out detectors are typically responsive to the decay of the gas generator speed below a normal idle speed minimum. Present engine failure detectors do not provide the pilot of a rotary wing aircraft with a warning in the case of either a flame-out or break in the power train between the free turbine and rotors.

DISCLOSURE OF THE INVENTION

The present invention overcomes the above-briefly discussed and other deficiencies and disadvantages of the prior art by providing a novel and improved technique for immediately recognizing a gas turbine engine failure. Apparatus in accordance with the present invention provides, in response to the sensing of either engine flame-out or power train failure, a warning signal which, in the case of a rotary wing aircraft environment, will alert the pilot to the need for initiating emergency procedures. Engine flame-out is detected, in the present invention, by sensing an unacceptably fast gas turbine deceleration rate. Output shaft breakage, or other drive train failure, is determined in the case of a turboshaft engine by comparing the speeds of the power turbine and load and recognizing any differences therebetween.

The present invention is also characterized by the ability to distinguish between normal transient conditions, such as pilot commanded rapid decelerations, engine surge and output shaft underspeeds and overspeeds due to external load changes, and an actual engine failure. Thus, a preferred embodiment of the invention will employ logic circuitry which will disable the engine failure detector during surge and during the occurrance of other "normal" transient conditions.

BRIEF DESCRIPTION OF DRAWINGS

The drawing is a functional block diagram of apparatus in accordance with a preferred embodiment of the invention.

BEST MODE OF CARRYING OUT THE INVENTION

The present invention relies, for operation, upon signals commensurate with a plurality of customarily sensed engine parameters. These parameters are as follows:

NP=power (free) turbine speed
NR=load speed
NG=gas generator speed
P1=gas generator compressor inlet (ambient) pressure The present invention also receives, as input to a surge detector, a CDP signal commensurate with the gas generator compressor discharge pressure.

A failure in the power train between the engine free turbine and the load is detected by the comparing, in a summing circuit 10, the free turbine speed NP with the load speed NR, the NR input to summing circuit 10 having been inverted prior to the comparison. When there is a drive train failure, for example a breakage of the free turbine output shaft, the turbine will be suddenly unloaded and start to run away and thus the NP signal will begin to increase. At the same time, since the load has lost its drive, the NR signal will begin to decay. As a result of transient conditions, for example wind gusts affecting the main rotor, and taking into account the response time of the speed sensors, small differences between NP and NR may occur without there being a drive train failure. Accordingly, the output of summing circuit 10 is applied as the input to a failure detection circuit 12 which may, for example, comprise merely a threshhold circuit which provides, in response to an error signal having a magnitude which is commensurate with an excess of two (2%) percent actual speed error, an output signal indicative of a power train failure. This output signal will, for example, be a logic level "one" and may, if deemed necessary or desirable, be applied to a latch circuit 14 whereby the failure indication will continue to be present until the latch circuit has been manually reset. The logic level output of latch circuit 14 is applied as a first input to an OR gate 16. It will be recognized by those skilled in the art that either or both of the NP and NR input signals to summing circuit 10 may be amplified as necessary to take into account any normal differences in speed between the power turbine and load produced by gearing in the drive train.

The signals commensurate with sensed gas generator speed NG and ambient pressure $P_1$ are delivered as inputs to a "mapping" circuit 18. Circuit 18 may comprise a microprocesser and associated memory which functions as a look-up table to provide an output signal commensurate with a minimum acceptable rate of change of gas generator speed, $NDOT_{(MIN)}$, for the actual NG and the operating altitude, altitude being a function of $P_1$. This $NDOT_{(MIN)}$ signal is applied as a first input to a further summing circuit 20.

The NG signal is also delivered, via a filter 22, to a differentiator 24 in order to generate an NDOT signal commensurate with the actual rate of change of gas generator speed. The filter removes noise from the NG signals. The NDOT signal from differentiator 24 is applied as the second input to summing circuit 20. Accordingly, the output of summing circuit 20 will be a signal commensurate with any difference between the minimum acceptable NDOT for the operating conditions and the actual NDOT. This NDOT error signal is applied as the input to a second threshhold circuit 28 which, in response to an input indicating that the actual NDOT has exceeded the $NDOT_{(MIN)}$, will provide a logic level "one" as its output. The output of threshhold detector 28 is applied as a first input to an AND gate 30.

The signal commensurate with sensed compressor discharge pressure is delivered, via a filter 31, to a differentiator 32 to generate a CDPDOT signal. This signal, which is a measure of the rate of change of compressor discharge pressure, is a measure of engine surge. Surge may be defined as a mismatch in the speed of the gas generator compressor blades and the incoming air. When a surge condition occurs there is a large loss of power, a loss of air flow, an increase in temperature and substantial mechanical vibration. An engine surge is a transient condition from which the engine will normally recover and is not indicative of a flame-out engine failure. However, during surge, NG may undergo a momentary decrease such that the NDOT error signal appearing at the output of summing circuit 20 would indicate a flame-out. Accordingly, steps must be taken to insure that the appearance of an engine failure indication at the output of threshhold circuit 28 during an engine surge will not cause an engine failure warning to be given to the pilot. To this end, the CDPDOT signal provided at the output of differentiator 32 is delivered via a threshhold circuit 33 and a normally closed switch to a NAND gate 34 which provides, in response to an input signal commensurate with the occurrence of a surge, a logic "O" output signal. The output signal of NAND gate 34 is delivered as the disabling input to AND gate 30. Accordingly, gate 30 will be disabled during periods when a surge is occurring. It is to be noted that while the surge detector 32 has been described as merely a differentiator, it may comprise any conventional surge detector sensitive to gas generator output temperature, gas generator speed or it may be a radiation pyrometer responsive to the gas generator exhaust products. The normally closed switch between threshhold circuit 33 and NAND gate 34 is responsive to a signal, fed back from the engine fuel control, indicative that the engine is in an acceleration mode, i.e., the surge detector is isolated from the engine failure detector when the engine is being accelerated.

The output of AND gate 30 is applied as a second input to the OR gate 16. The output of gate 30 will be a logic "one" when both inputs to gate 30 are at the logic "one" level thus indicating that the engine is not in surge and the rate of change of gas generator speed is exceeding a scheduled minimum for the ambient operating conditions.

In addition to detecting power train failure and engine flame-out, the present invention will provide a signal commensurate with gas generator underspeed. To this end, the NG signal is delivered as a first input to a further summing circuit 36. The second, opposite polarity, input to circuit 36 is a reference signal commensurate with a typically normal idle speed, i.e., sixty (60%) percent of rated gas generator speed. When the actual gas generator speed decreases below the idle speed, a positive input signal will be applied to a threshhold detector 38 which will provide a logic "one" at its output. This gas generator underspeed signal is delivered, via a normally closed switch 40, as the third input to OR gate 16. Switch 40 will comprise an electronic switch which is responsive to the setting of the pilot's power lever, i.e., the controlling input to switch 40 is the PLA (power lever angle) signal which will be indicative of the engine being in a start or shut-down mode. During start-up or shut-down switch 40 will be opened so that a false engine failure signal is not delivered to OR gate 16.

The output of OR gate 16 will comprise an enabling signal for an annunciator 42 which may comprise either or both of a warning light or audible warning device. Accordingly, the pilot will be advised, immediately upon occurrence of a drive train failure, engine flame-out or gas generator underspeed, that there has been an engine failure and corrective action, for example, operation in an auto-rotation mode in the case of a rotary wing aircraft, should be instituted. The present invention provides the pilot with an engine failure indication earlier than prior art devices described above and has the ability of detecting, immediately subsequent to the occurrence thereof, three different conditions which are indicative of an engine failure.

While a preferred embodiment has been shown and described, various modifications and substitutions may be made thereto without departing from the spirit and scope of the invention. Accordingly, it will be understood that the present invention has been described by way of illustration and not limitation.

We claim:

1. A gas turbine engine failure detector, the engine being instrumented to provide signals commensurate with engine output shaft and load speed and engine gas generator speed, said detector comprising:

means for comparing the signals commensurate with output shaft and load speed and producing a speed error signal indicative of any difference therebetween;

means responsive to a speed error signal corresponding to an output shaft speed which exceeds the load speed by a preselected amount for generating a first engine failure signal;

first means responsive to a gas generator speed signal for producing a signal commensurate with the actual rate of change of the gas generator speed;

second means responsive to a gas generator speed signal for producing a variable signal commensurate with the gas generator speed rate of change limit for the operating conditions;

means for comparing said signals commensurate with the actual gas generator rate of change of speed and rate of change of speed limit for generating a second engine failure signal when the actual rate of change of speed exceeds the limit; and means responsive to said first and second failure signals for providing an engine failure warning.

2. The apparatus of claim 1 further comprising;

means for sensing a transient gas generator condition and providing a control signal commensurate therewith;

means responsive to said control signal for isolating said failure warning providing means from said second failure signal.

3. The apparatus of claim 2 wherein said transient condition is engine surge.

4. The apparatus of claim 3 further comprising:

means responsive to a gas generator speed signal for generating a third engine failure signal when the gas generator speed is below a normal idle speed; and means for delivering said third failure signal to said failure warning providing means.

5. The apparatus of claim 4 wherein said delivering means comprises:

switch means, said switch means being responsive to the commanded operating mode of the engine for isolating said warning providing means from said third failure signal during engine start-up and deliberate shut-off.

6. The apparatus of claim 5 wherein said second failure signal is indicative of a flame-out condition and wherein said means for providing a variable rate of change of speed limit signal comprises:

computer means, said computer means including memory means with normal rate-of-change data stored therein, said computer means being responsive to the gas generator speed signal and a signal commensurate with the ambient pressure.

7. The apparatus of claim 3 wherein said second failure signal is indicative of a flame-out condition and wherein said means for providing a variable rate of change of speed limit signal comprises:

computer means, said computer means including memory means with normal rate-of-change data stored therein, said computer means being responsive to the gas generator speed signal and a signal commensurate with the ambient pressure.

8. The apparatus of claim 7 wherein the engine instrumentation also provides a signal commensurate with a gas generator discharge pressure and wherein said control signal providing means comprises:

means responsive to a signal commensurate with the gas generator discharge pressure for producing a control signal which is a function of the rate of change of the gas generator discharge pressure.

9. The apparatus of claim 1 further comprising:

means responsive to a gas generator speed signal for generating a third engine failure signal when the gas generator speed is below a normal idle speed; and means for delivering said third failure signal to said failure warning providing means.

10. The apparatus of claim 1 wherein said second failure signal is indicative of a flame-out condition and wherein said means for providing a variable rate of change of speed limit signal comprises:

computer means, said computer means including memory means with normal rate-or-change data stored therein, said computer means being responsive to the gas generator speed signal and a signal commensurate with the ambient pressure.

11. The apparatus of claim 1 wherein said failure signals are coded and wherein said warning providing means includes logic circuit means responsive to either of the coded failure signals.

* * * * *